United States Patent [19]

Sangalli

[11] 4,201,032

[45] May 6, 1980

[54] APPARATUS FOR MAKING BUNDLES OF TEXTILE STRANDS

[75] Inventor: Silvio Sangalli, Caluire, France

[73] Assignee: Rhone-Poulenc-Textile, Lyon Cedex, France

[21] Appl. No.: 878,462

[22] Filed: Feb. 16, 1978

[30] Foreign Application Priority Data

Mar. 21, 1977 [FR] France ..... 77 08618

[51] Int. Cl.[2] ..... D04H 11/00; D04H 13/00; D01G 37/00

[52] U.S. Cl. ..... 53/522; 83/262; 83/460; 156/435; 156/461; 156/518; 156/519; 156/438

[58] Field of Search ..... 156/72, 435, 433, 438, 156/166, 441, 200, 201, 180, 203, 461, 264, 466, 250, 251, 272, 465, 296, 515, 510, 519, 518, 517, 520, 552; 28/165, 218, 226; 226/95, 118, 119, 104; 227/152; 269/22, 20, 317; 83/262, 460, 462, 913; 53/435, 456, 513, 545, 547, 582, 522; 428/95, 92

[56] References Cited

U.S. PATENT DOCUMENTS

| | | | |
|---|---|---|---|
| 2,438,156 | 3/1948 | Dodge | 156/72 |
| 2,672,640 | 3/1954 | Peterson et al. | 156/72 |
| 2,732,882 | 1/1956 | Kuts | 156/203 |
| 3,016,945 | 1/1962 | Wexler | 156/465 |
| 3,253,854 | 5/1966 | Hollander, Jr. | 269/22 |
| 3,499,807 | 3/1970 | Hurtes | 156/72 |
| 3,673,048 | 6/1972 | Gidge et al. | 156/72 |
| 3,850,713 | 11/1974 | Hurtes | 156/72 |
| 3,889,450 | 6/1975 | Danielson et al. | 156/552 |
| 3,943,028 | 3/1976 | Davis | 156/435 |
| 4,093,493 | 6/1978 | Welch et al. | 156/552 |

*Primary Examiner*—Michael W. Ball
*Attorney, Agent, or Firm*—Sherman & Shalloway

[57] ABSTRACT

An apparatus for cutting textile strands and forming the cut strands into bundles including a means for supplying the textile strands. A means for positioning the textile strands funnels the textile strands into a grouping of substantially parallel strands having a substantially cylindrical cross-section. A means for wrapping the parallelly arranged strands places a wrapper of paper around the strands and secures it by adhesive. A capstan guides the parallel strands to an accumulator pipe which has at its end a means for cutting the strands. The strands are held and retained so that a blade can cut them and the ends of the strands of the bundle are joined by adhesive or heat. An adhesive strip is tangentially attached to the sides of the bundles so that they may be wrapped around a rotating shaft.

19 Claims, 3 Drawing Figures

APPARATUS FOR MAKING BUNDLES OF TEXTILE STRANDS

BACKGROUND OF THE INVENTION

1. Field of the Invention

The invention generally relates to an apparatus for cutting textile strands and forming the cut strands into bundles with joined ends and, more specifically, relates to an apparatus for guiding, positioning, and cutting textile strands and joining the ends of the cut strands.

2 Description of the Prior Art

The prior art generally includes machines for cutting textile strands into bundles. The prior art machines generally suffer from deficiencies in that the means for supplying the strands to the machine is cumbersome, the handling of the strands is complex and the cutting of the strands requires a sophisticated apparatus. In addition, the prior art machines do not provide for allowing the ends of the strands to be joined.

SUMMARY OF THE INVENTION

The invention includes an apparatus for supplying the textile strands by passing the strands through a comb and into a funnel. The funnel gathers the strands into a substantially cylindrical cross-section and allows the application of a wrapper which is secured to the strands by an adhesive strip which is applied to the strands. These parallel strands are guided through a capstan and accumulator pipe to a cutter which holds the strands in position while a blade is applied thereto for cutting. One end of the cut strands is then acted on by heat or adhesive to join the ends of the strands together and an adhesive strip is applied to the side of the bundles in order to allow the bundles to be assembled around a rotating shaft.

It is an object of this invention to provide an apparatus which supplies textile strands so that they may be positioned in parallel relation and wrapped.

It is another object of this invention to provide an apparatus which cuts parallel strands into bundles and allows the ends of the bundle of strands to be joined by adhesive or heating.

BRIEF DESCRIPTION OF THE DRAWINGS

These and other objects will become apparent to those skilled in the art by referring to the drawings in which.

DETAILED DESCRIPTION OF THE INVENTION

Figure 1:
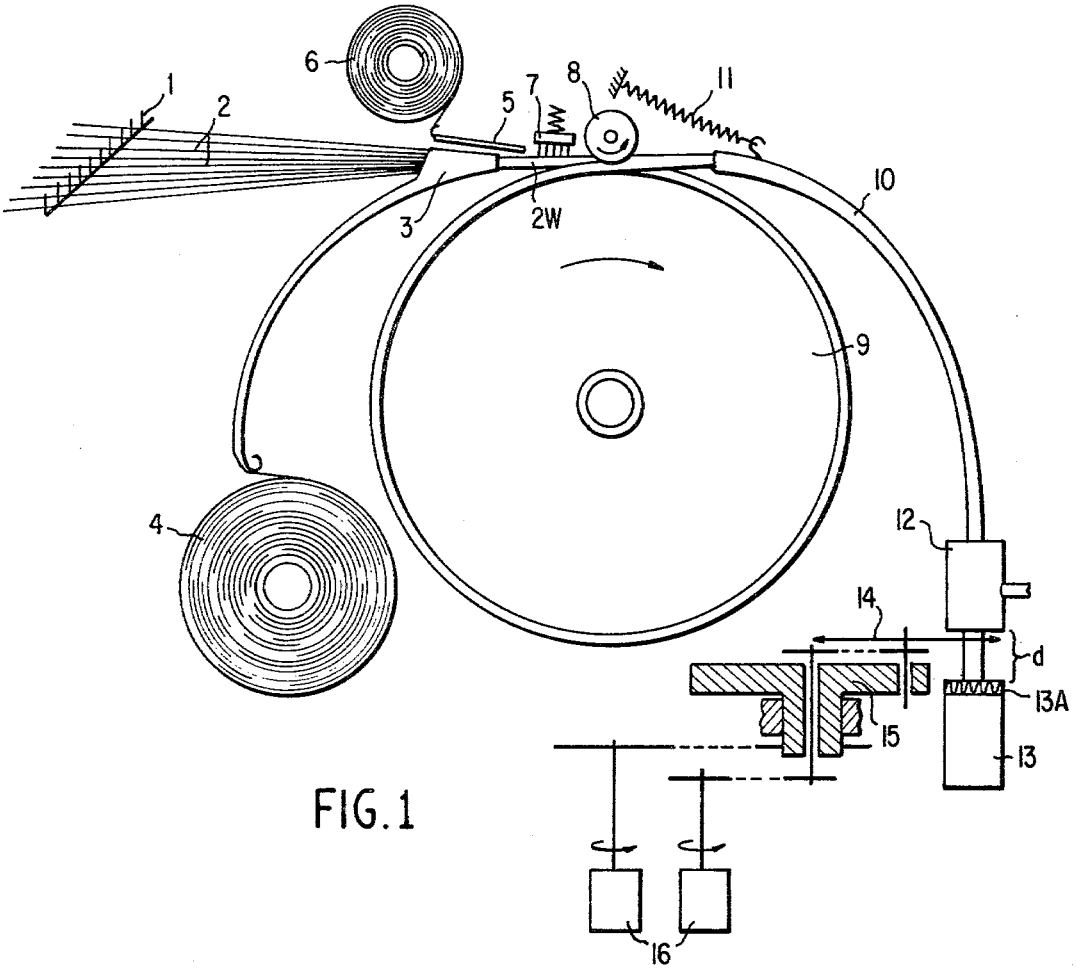
FIG. 1 is a view of an embodiment of the invention wherein a pneumatic unit is used to hold and retain the parallel strands.

The incoming textile strands 2 or filamentary textile structures are provided to the apparatus by a means for supplying which includes a comb structure 1 holding the textile strands 2 in a separated arrangement. The strands 2 can enter the comb 1 from any conventional source which may supply them, such as reels mounted on a creel (not shown). The strands 2 are guided through a funnel 3 which is the basis for the means for positioning the strands 2.

The funnel 3 has a structure which is dependent upon the shape of the bundles to be made. Specifically, the funnel tapers into an opening or mouth with a cross-section which may be shaped flat, oval or round so that after the strands pass through the funnel, the strands have a cross-section which is the same as the opening in the funnel and which provides the resultant shape desired. The strands may also be treated at or before this point with any specific process which may be desired. For example, if the strands are required to be dyed or their texture is to be treated with a liquid, the funnel can be altered to allow for this treatment process to occur at this point. On the other hand, a dying means as described in U.S. Pat. Nos. 3,751,778 and 3,955,254 can be attached to the capstan 9.

The funnel 3 also allows the placement of a wrapper 4 around the shaped strands. The specific structure of the funnel which allows the function of wrapping is to depend upon the nature of the wrapper, for example, resin, film, paper, crepon, etc. A securing means then acts on the wrapper to secure it around the parallel strands. In the embodiment shown, a removable wrapper 4 of paper is illustrated wherein a guide 5 applies an adhesive strip 6 to the paper and a brush 7 permits the adhesive strip to be pressed onto the paper. The wrapper enters the funnel 3 with the strands 2 so that, as the strands leave the mouth of the funnel, the wrapper surrounds the strands. The wrapper has a dual purpose in that it provides a means for holding the textile strands in place for the remainder of the operation of the apparatus and it provides a means for securing the strands after the cutting operation. The wrapper is usually removable so that when the cut bundles are later employed for use, the wrapper can be disengaged from the bundles.

When the wrapper is a plastic film, it is fed into the funnel 3 with the strands 2 in order to provide a complete wrapping of the textile strands 2. In such a case, the securing means would be a heating means which would attach the ends of the plastic film wrap together and the guide 5 would be, for example, a roll, an endless belt or a capstan which is optionally associated with the funnel 3.

An assistance wheel 8 is provided to press the wrapped strands on the guide means such as, for example, a roll, endless belt or capstan 9 around which the strands are wound. To complete the transportation of the wrapped parallel strands, the wrapped strands 2W pass into an accumulator structure 10 which, in the preferred embodiment, is in the form of a flexible pipe or tubing flexibly held in place by an assistance spring 11.

Figure 3:
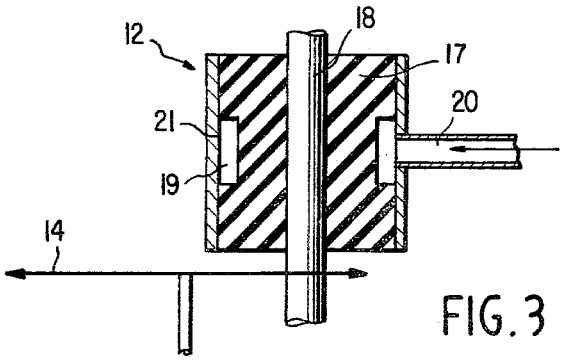
FIG. 3 is a view of an embodiment of the invention wherein the parallel strands are cut and the ends are joined by heat and the bundles are assembled around a rotating shaft.

As shown in FIGS. 1 and 3, the end of the accumulator structure 10 may include a pneumatic member 12 which allows for the retention and holding of the parallel wrapped strands 2W joined in the wrapper during the cutting. The pneumatic member 12 shown in FIG. 3 is an elastomeric cylindrical body 17 surrounded by cylinder 21 which prevents expansion of the body 17 when ring 19 is collapsed. The body 17 has an axial aperture or central channel 18 therein for receiving the parallel wrapped strands 2W. A hollow ring 19 which deforms and collapses under pressure is located around the body 17 is connected to a pneumatic source through conduit 20. The ring 19 is selectively pressurized to hold the strands in place for cutting. The member 12 functions in synchronization with the cutting blade 14 and is controlled by a three way valve (air intake, compression of the element and expansion) placed on the air supply connected to conduit 20. Unit 13 provides a dual purpose in that its distance d from member 12 establishes the size of the bundles of strand, therefore, acting as a stop. The unit 13 may also include a means for joining the ends of the bundle of strands. For example, the top 13A of the unit may be a heating element on which the ends of the wrapped strands strike and are heated and fused together. In an alternative embodiment, the end 13A may include a means for applying adhesive to the ends of the strands of the bundle.

In order to cut the bundle from the continuous parallel strands, cutting blade 14 is held in a blade holder 15 which is driven in rotation by motors 16. Alternatively, the means for cutting the strands into bundles of predetermined length can be a laser, shears, saw, high pressure jet or a cutting blade acting as a slicing or guillotine blade.

Figure 2:
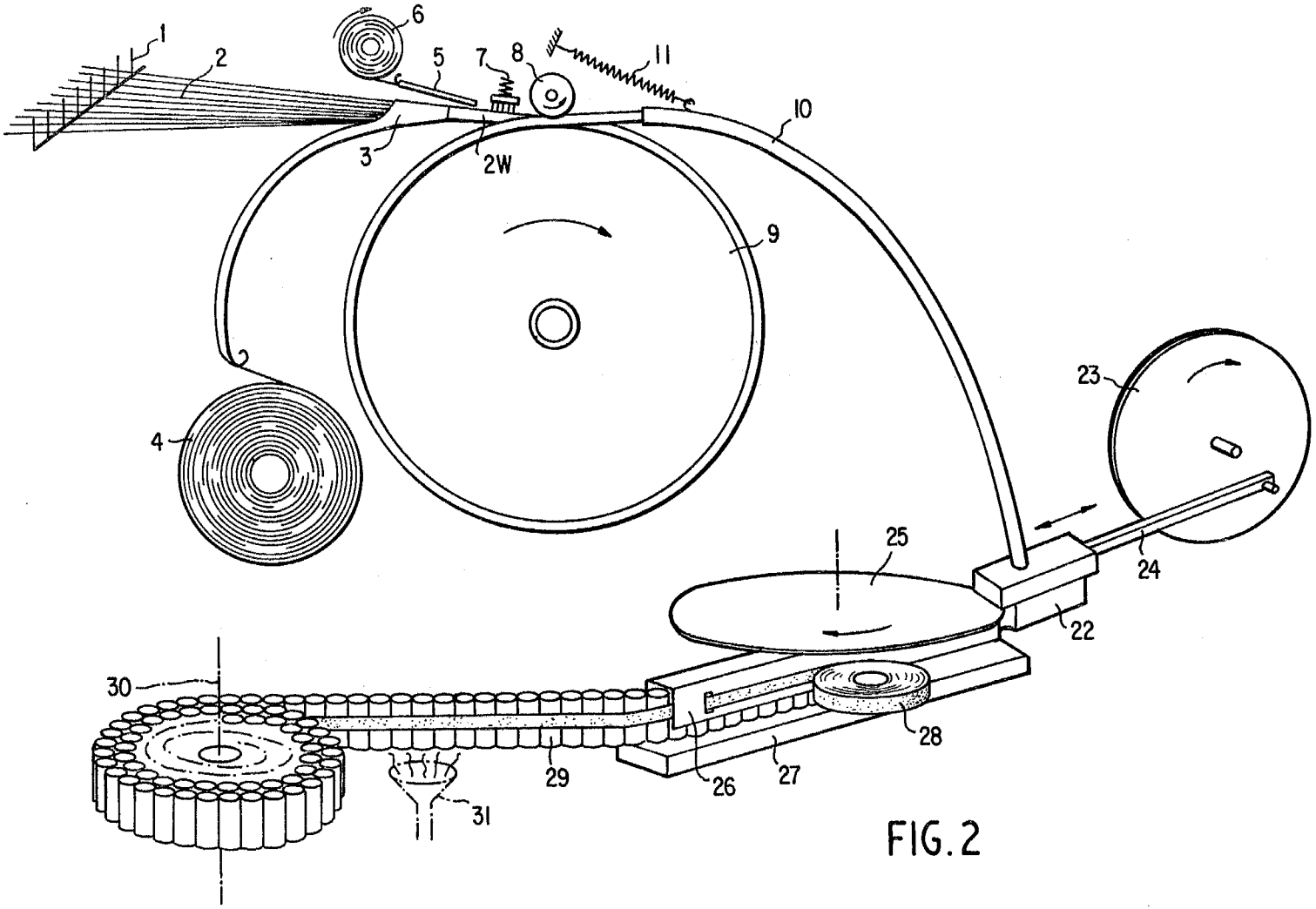
FIG. 2 is a sectional view of the pneumatic unit used in FIG. 1.

An alternative cutting and bundle handling apparatus is illustrated in FIG. 2. The accumulator 10 is connected by its output to a unit 22. The unit 22 is connected to a means for providing reciprocating motion such as a rotating disc 23 having an eccentric arm 24 connected thereto. This provides the unit 22 with rectilinear forward and backward movements from cutting blade 25. A holding means 26 accepts the bundle of strands after the inward motion of the unit 22 results in the cutting by blade 25. Heating plate 27 is provided in combination with the holding means 26 to heat the bottom ends of the strands of the bundle and fuse them together or otherwise join them into a single unit. In place of holding means 26, the bundles can be collected in an appropriate container such as a basket or the bundles can be provided to a delivery means such as a plastic tube. Alternatively, plate 27 can be a means which allows the adhesive joining of the ends of the bundle. Adhesive strip 28 is perpendicularly and tangentially applied to the cut wrapper of the cut elements 29. This allows the elements to be wrapped around a rotating shaft 30 for collection and storage. Plate 27 may be provided without heating means, the fusing of the ends of the elements being obtained by infrared heating means 31.

MODE OF OPERATION

In the operation of the apparatus as shown in FIG. 1, the textile strands 2, coming from comb 1, are fed into funnel 3 which at the same time receives paper 4. As the paper and the parallel strands pass through the funnel 3, they are directed into a shape which coincides with the mouth of the funnel and the result is a structure of strands contained within the paper. Adhesive strip 6 is applied to the side ends of the paper and pressed on by brush 7 to provide an envelope of strands within paper.

The wrapped strands 2W pass around the rotating wheel or capstan 9 via the assistance roller 8 and then into a flexible accumulator pipe 10 which is suspended by assistance spring 11. The wrapped strands then come into contact with the pneumatic member 12 which assures the immobilization of the strands during cutting and is controlled by a pressurized source (not shown). The wrapped bundles advance and strike a heated unit 13 which fuses the ends of the strands by melting, the cut being performed by the turning blade 14 at a predetermined height d from the end.

The operation of the apparatus as shown in FIG. 2 is similar to that described above through the point at which the parallel strands enter the accumulator 10. The elements then leave accumulator 10 into unit 22 which is in a disengaged position with relation to cutting blade 25. As the disc 23 turns, the arm 24 moves the unit 22 forward thrusting the unit against the blade 25 and cutting the strands located within the unit 22 into a bundle. The bundle of cut strands is then introduced into receiving unit 26. Each additional new bundle placed into receiving unit 26 forces the bundles located within receiving units 26 to move forward. The roll of bundles pass over the plate 27 which assures heat or glueing of the base of the elements which, in a line position, are connected to one another by an adhesive strip 28. The elements connected together continue to travel and wind around a shaft 30 driven in a rotational movement for taking up the strip 28 attached to the bundles 29.

In addition to the above operation, after processing of the bundles 29, a crimping means may be applied to the base of the bundles to shape the base of the fused strands and their ends. Alternatively, the elements may be drawn or include partially oriented textiles.

The bundles 29 are thus made easily and can be used for making floor coverings, for example, by glueing the bundles together to a support. As will be obvious to one skilled in the art, the apparatus may be used for the assembly of any group of parallel strands which require cutting into a bundle and processing of the bundle. For example, textile elements 50 mm long, 10 mm in diameter, from polyhexamethylene adipamide yarns with a count of 2300 dtex/136 strands, fed at 10 meters/minute can be employed to make textile bundles.

What is claimed is:

1. An apparatus for cutting textile strands and forming the cut strands into bundles comprising:

(a) a means for supplying and feeding the textile strands;

(b) means for positioning the textile strands cooperating with said means for supplying and feeding;

(c) means for gathering the strands into a parallel relation cooperating with said means for positioning;

(d) means for wrapping the parallel relation of strands cooperating with said means for gathering;

(e) means for continuously feeding the wrapped, parallel relation of strands cooperating with said means for wrapping, said means for continuously feeding including a rotating capstan around which the textile strands are wound and a flexibly supported accumulator pipe connected to the capstan;

(f) means for cutting the wrapped, parallel relation of textile strands to form a bundle of strands having top ends and bottom ends cooperating with said means for continuously feeding; and (g) means for joining the bottom ends of the bundle of strands connected to said means for cutting.

2. The apparatus of claim 1 wherein said means for positioning includes a comb means for separating and holding the strands.

3. The apparatus of claim 1 wherein said means for gathering includes a funneling means which guides the strands together in a substantially parallel relation, said funneling means tapering to an opening having a cross-section which is substantially cylindrical.

4. The apparatus of claim 1 wherein said means for wrapping includes a guide means for positioning a wrapper around the parallel strands and an adhesive means for affixing the wrapper around the strands.

5. The apparatus of claim 4 wherein said wrapper is comprised of paper.

6. The apparatus of claim 5 wherein said adhesive means includes an adhesive strip and a means for applying the adhesive strip to the wrapper.

7. The apparatus of claim 1 wherein said means for joining is comprised of a means for heating the bottom ends of the bundle of strands.

8. The apparatus of claim 7 wherein said means for heating includes a heat plate which is positioned to come in contact with the ends of the bundle of strands.

9. The apparatus of claim 1 wherein said means for joining includes a means for applying adhesive to the ends of the bundle of strands.

10. The apparatus of claim 1 further comprising a means for dyeing the textile strands.

11. The apparatus of claim 1 wherein said means for cutting further includes a means for holding and retaining the parallel strands in position and a blade means for cutting the strands while the strands are held in the retained position.

12. The apparatus of claim 11 wherein said means for holding and retaining is comprised of a pneumatic member having an elastomeric cylindrical body having an axial aperture therein for receiving the parallel strands, and a ring which collapses when placed under pressure, said ring located around the body.

13. The apparatus of claim 11 wherein said means for holding and retaining is connected to a reciprocating means which moves the means for holding and retaining toward and away from said blade means.

14. The apparatus of claim 13 wherein a means for transferring is connected to said blade means for receiving and transferring the cut strands.

15. The apparatus of claim 14 wherein said means for joining is comprised of heating means connected to said means for cutting for heating the bottom ends of the bundle of strands.

16. The apparatus of claim 15 wherein said heating means is a heat plate.

17. The apparatus of claim 14 wherein a storage means is connected to said means for transferring said storage means for retaining and assembling the cut textile strands.

18. The apparatus of claim 17 wherein said means for transferring includes an adhesive strip applying means for attaching an adhesive strip to the side of said bundle of strands.

19. The apparatus of claim 18 wherein said storage means includes a shaft around which the adhesive strip and bundles are wound.

* * * * *